US006550143B1

(12) United States Patent
Derome

(10) Patent No.: US 6,550,143 B1
(45) Date of Patent: Apr. 22, 2003

(54) UNIQUE DOUBLE BLADED UTILITY KNIFE

(75) Inventor: Robert E. Derome, New Ipswich, NH (US)

(73) Assignees: Hermel Pelletier, Greenville, NH (US); Angela Sennett, New Ipswich, NH (US)

( * ) Notice: Subject to any disclaimer, the term of this patent is extended or adjusted under 35 U.S.C. 154(b) by 0 days.

(21) Appl. No.: 09/494,914

(22) Filed: Jan. 31, 2000

(51) Int. Cl.[7] ..... A26B 1/08
(52) U.S. Cl. ..... 30/162; 30/335
(58) Field of Search ..... 30/162, 151, 152, 30/329, 335

(56) References Cited

U.S. PATENT DOCUMENTS

| | | | | |
|---|---|---|---|---|
| 719,208 A | | 1/1903 | Garda | |
| 1,599,800 A | | 9/1926 | Van Sickel | |
| 3,906,627 A | | 9/1975 | Manning | |
| 4,517,741 A | | 5/1985 | Castelluzzo | |
| 4,578,865 A | | 4/1986 | Keller | |
| 4,663,845 A | * | 5/1987 | Weimann | 30/162 |
| 4,884,342 A | | 12/1989 | McNamara | |
| 4,936,014 A | * | 6/1990 | Shaanan et al. | 30/162 |
| 5,093,994 A | | 3/1992 | Karas | |
| 5,174,028 A | | 12/1992 | Seltzer | |
| 5,241,750 A | | 9/1993 | Chomiak | |
| 5,337,481 A | | 8/1994 | Mears | |
| 5,406,707 A | * | 4/1995 | Owens et al. | 30/162 |
| 5,495,670 A | | 3/1996 | Quinn | |
| 5,720,105 A | | 2/1998 | Gates | |
| 5,906,049 A | | 5/1999 | Butts | |
| 5,906,050 A | | 5/1999 | Gulbert | |
| 5,940,970 A | | 8/1999 | D'Ambro | |
| 5,960,544 A | | 10/1999 | Beyers | |

* cited by examiner

*Primary Examiner*—Hwei-Siu Payer
(74) *Attorney, Agent, or Firm*—Bourque & Associates, PA

(57) ABSTRACT

This invention provides a unique utility knife, which has at least two extendable and retractable parallel blades. The blades are easily operated with one hand by a mechanism on a non-force-bearing surface of the knife. The blade handle of this utility knife may be bent to enhance the ergonomic ease of use of the knife. As a result, the utility knife is efficient, as well as safe, convenient and economical.

4 Claims, 7 Drawing Sheets

UNIQUE DOUBLE BLADED UTILITY KNIFE

BACKGROUND OF THE INVENTION

This invention relates to an independently retractable, double bladed, utility knife.

Utility knives with retractable blades have been used in a variety of applications for many years. These blades suffer from several shortcomings in certain applications. For example, in the roofing trade it is generally necessary for a roofer to carry two separate utility knives. One knife is equipped with a straight razor blade for cutting felt paper and the like, while the other knife is equipped with a hooked blade for cutting shingles which have a granulated surface. Neither of these knives is well adapted for cutting the other type of material. As a result, it is often necessary to switch knives. To accomplish this, the user must retract the first blade and put it away before retrieving the second knife and extending its blade. This is inconvenient and inefficient, as it must be repeated again and again during the workday.

There have been prior attempts to solve this problem. For example, U.S. Pat. No. 719,208 to Garda relates to a plurality of blades and a fork attached to a common handle which are pivotable in relation to each other to allow for individual use. U.S. Pat. No. 1,599,800 to Van Sickel discloses adjustable parallel blades extending from a common holder. U.S. Pat. No. 5,093,994 to Karas and U.S. Pat. No. 5,960,544 to Beyers disclose double bladed utility knives. These knives have a blade at opposite ends. To switch blades, the first blade must be retracted, the knife turned in the hand and the second blade extended. U.S. Pat. No. 4,578,865 to Keller relates to a double bladed utility knife having concurrent advancement and retraction of the blades. These attempts suffer from the inconvenience and inefficiencies associated with the use of two separate knives, since in each case to switch blades, the user must retract, manipulate the knife, and extend blades, switch blades entirely or again use two knives.

U.S. Pat. No. 5,337,481 to Mears discloses an invention which improves on the prior art but which has additional shortcomings. Mears discloses a double bladed utility knife which has parallel, individually retractable blades which extend from one end of the knife and are operated by a retraction mechanism located on the top surface of the blade housing. In use, the roofer must apply pressure to the knife to allow the blade to cut the roofing material. The only surface available for applying such pressure is the top surface of the blade, causing the retraction mechanism to injure the users' fingers or at least reduce the amount of pressure available to be brought to bear on the blade. In addition, the Mears' utility knife is longitudinally oriented to form a rectangular shape. This orientation does nothing to improve the ease of use, especially when combined with the placement of the retraction mechanism on the top surface of the knife.

None of these prior inventions features a utility knife with a pair of independently extendable blades at one end of the knife, which is ergonomically designed and oriented to be easily operable with one hand by a mechanism on the side of the knife, as well as safe, convenient and economical.

SUMMARY OF THE INVENTION

This invention provides a unique utility knife, which has two different parallel blades. The blades are independently extendable and retractable from one end of the knife by a simple mechanism located on the side of the knife.

More specifically, this invention consists of two handle parts, which are parallel to each other and are essentially mirror images of each other. Placed between these two handle parts and separating them is a central handle part. These parts are all pierced by openings, which are aligned in a way that allows passage of an attachment means. The attachment means maintains proper alignment of the utility knife and enables the parts to be joined or separated in order to replace the blades. In addition to attachment openings, a slot pierces the two handle side surfaces to allow passage of the lever for extending and retracting the blades.

In one of the preferred embodiments, the handle parts are essentially longitudinally oriented to form a parallelogram. In a second preferred embodiment, the handle assembly is shaped so that the two blades disposed therein are offset from the main, longitudinal axis of the handle parts to form an angle which reduces strain on the user.

The handle parts have an external surface with which the user comes in contact, a front through which the cutting blades pass, a rear opposite the front, a top surface on which the user applies pressure to cut, and a bottom surface contiguous with the cutting surface of the blades.

Inside the knife are two depressions, one in each handle part, each of which contains a slidable blade holder and a cutting blade. These depressions begin as openings on the front of the knife and extend inwardly towards the rear. Attached to the slidable holder is a lever, which extends through a slot in the handle to the exterior, allowing the user to operate the blades. These levers are disposed on the side surfaces, also called the external user surfaces, of the handle parts to allow the user to apply pressure more effectively to the utility blade cutting edges.

The central handle part has two raised tracks on each side which are parallel to each other as well as the top and bottom of the central handle part and extend inward perpendicularly from the front of the knife. These tracks match the two depressions, one in each handle to hold the blade holder and blade in position.

Accordingly, it is the object of the present invention to provide an improved utility knife having double blades so that a user may carry and use one knife instead of two. Another objective of the present invention is to provide a double bladed utility knife, which requires no manipulation other than extension or retraction of the blades by simple movement of the fingers. Yet another objective of the present invention is to provide a retraction mechanism placed in such a way as to allow maximum pressure to be exerted on the knife and hence, the blades, without causing pain or added exertion to the user. Still another objective of the present invention is to provide a more ergonomically correct utility knife by improving the orientation of the handle parts.

DETAILED DESCRIPTION OF THE PREFERRED EMBODIMENT

Figure 1:
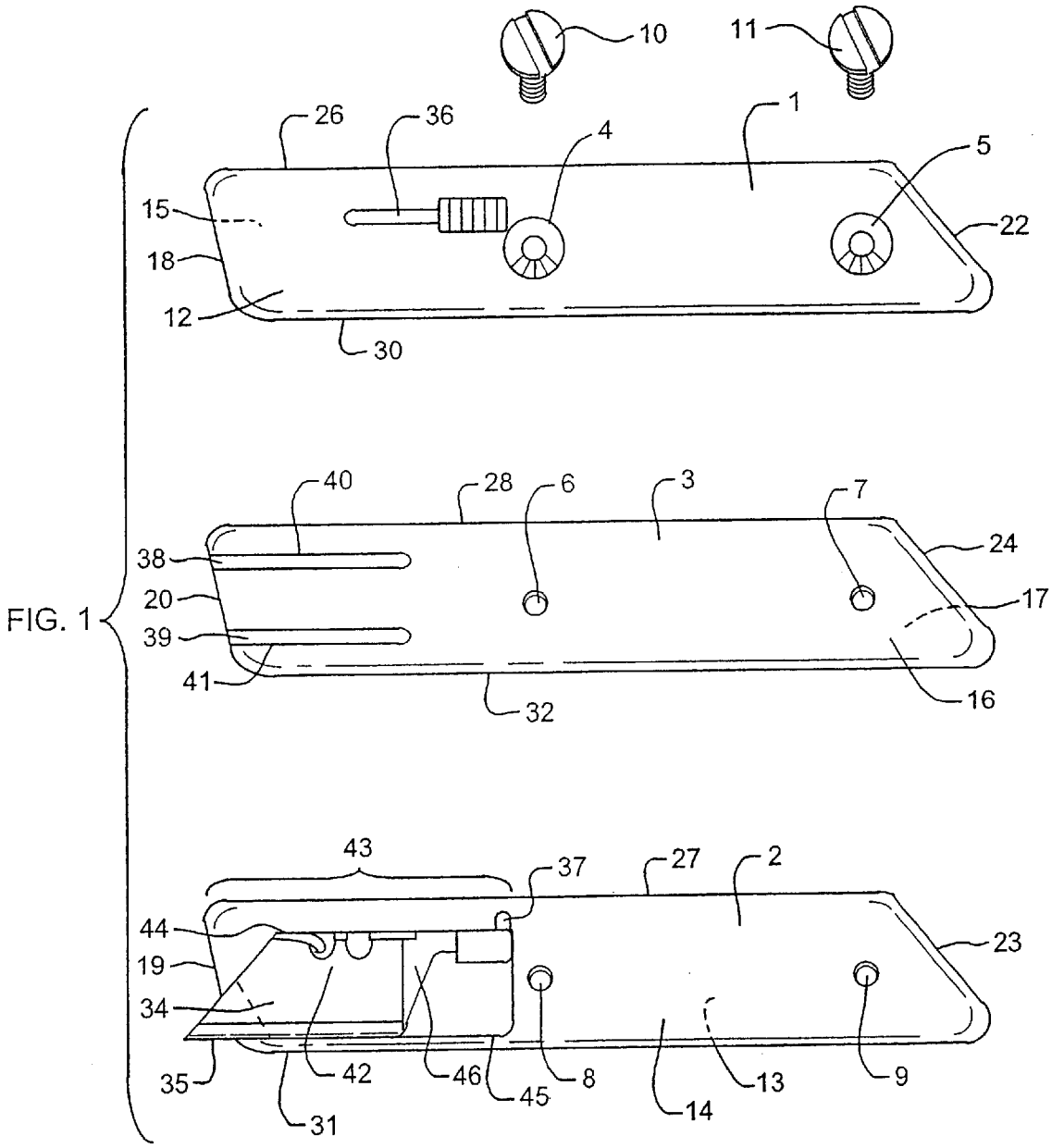
FIG. 1 is a cross-sectional view of the utility knife of the present invention, viewed from the entry surface of the attachment means.
Figure 2:
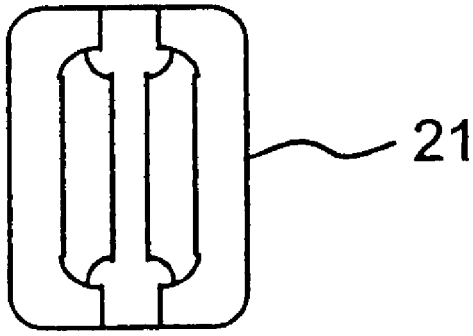
FIG. 2 is a front view of the exterior of the utility knife of the present invention, from which end the blades extend.
Figure 3:
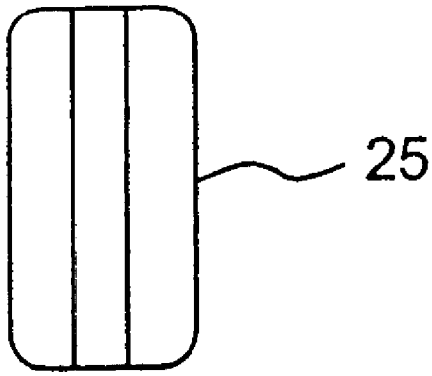
FIG. 3 is a rear view of the utility knife of the present invention.
Figure 4:
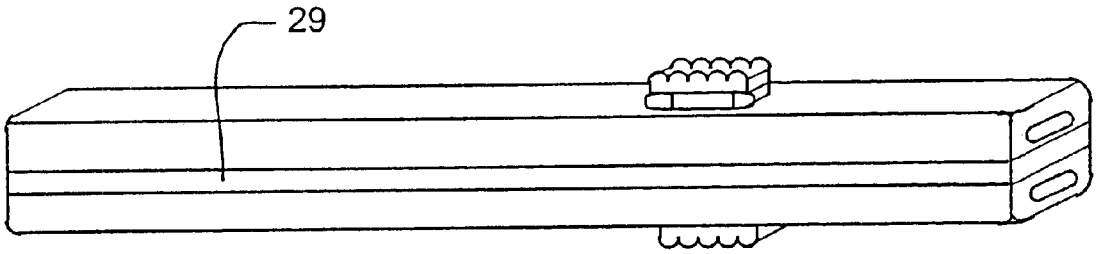
FIG. 4 is a top perspective view of the exterior of the utility knife of the present invention.
Figure 5:
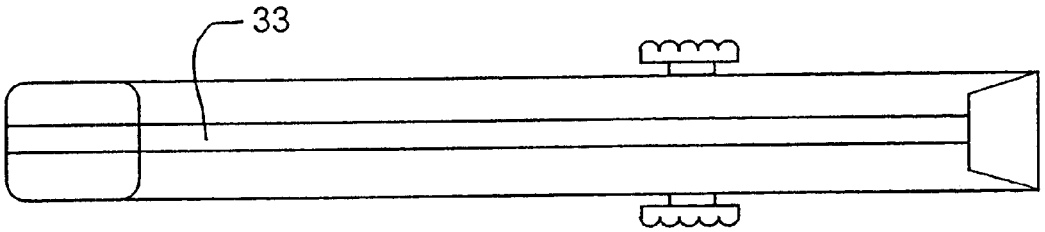
FIG. 5 is a bottom perspective view of the exterior of the utility knife of the present invention.
Figure 6:
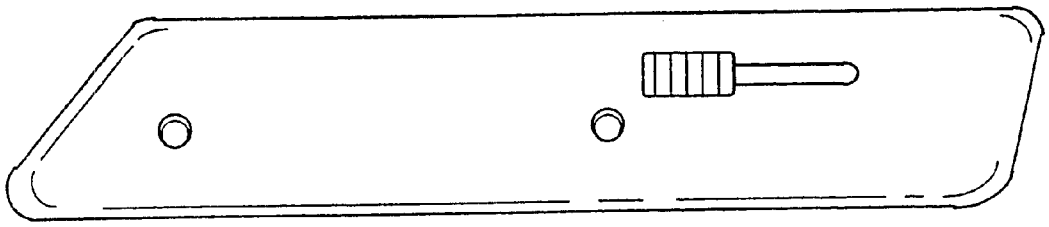
FIG. 6 is a cross-sectional view of the utility knife of the present invention, viewed from the entry surface of the attachment means. (See also FIG. 1)

FIGS. 1–10 depict one of the preferred embodiments of the present invention. The utility knife as assembled for use is illustrated by FIGS. 4, 5, and 6. A cross-sectional view of the utility knife of the present invention is illustrated in FIG. 1. The utility knife comprises a first handle part 1 and a second handle part 2, which are parallel to each other and essentially mirror images of each other. Placed between these two handle parts and separating them is a central handle part 3. First handle part 1 is pierced by attachment openings 4 and 5, second handle part 2 is pierced by attachment openings 8 and 9, and central handle part 3 is pierced by attachment openings 6 and 7. These openings are aligned in such away to allow passage of attachment means 10 and 11. The attachment means maintains proper alignment of the utility knife and removal of the attachment means allows replacement of the blades.

Handle parts 1, 2 and 3 have six surfaces each: two side surfaces, a front, a rear, a top and a bottom surface for each part. Handle parts 1 and 2 have external user surfaces 12 and 13, and blade holder surfaces 14 and 15 which are parallel to each other. The central handle part 3 has a first blade supporting surface 16 and a second blade-supporting surface 17, each surface being a mirror image of the other. The first blade supporting surface 16 is in contact with blade holder surface 15 of first handle part 1 and second blade supporting surface 17 is in contact with blade holder surface 14 of second handle part 2.

First handle part 1 has a front 18, second handle part 2 has a front 19, and central handle part 3 has a front 20. These fronts are aligned to form a flat front face 21, shown in FIG. 2, perpendicular to the handle external user surfaces of handle parts 1 and 2 and the blade supporting surfaces of central handle part 3. It is from this face that the blades extend.

First handle part 1 has a rear 22, second handle part 2 has a rear 23, and central handle part 3 has a rear 24. These rears are aligned to form a flat rear face 25, shown in FIG. 3, perpendicular to the handle external user surfaces of handle parts 1 and 2 and the blade supporting surfaces of central handle part 3.

First handle part 1 has a top 26, second handle part 2 has a top 27, and central handle part 3 has a top 28. These tops are aligned to form a flat top face 29, shown in FIG. 4, perpendicular to the handle external user surfaces of handle parts 1 and 2 and the blade supporting surfaces of central handle part 3 and at an angle to front face 21 and rear face 25 to form a three-dimensional parallelogram.

First handle part 1 has a bottom 30, second handle part 2 has a bottom 31, and central handle part 3 has a bottom 32. These bottoms are aligned to form a flat bottom face 33, shown in FIG. 5, perpendicular to the handle external user surfaces of handle parts 1 and 2 and the blade supporting surfaces of central handle part 3 and at an angle to front face 21 and rear face 25 to form a three-dimensional parallelogram. The bottoms 30, 31, and 32 and bottom face 33 are easily differentiated from tops 26, 27, and 28 and top face 29, since the bottom sides are nearest the cutting edge 35 of blade 34.

In addition to attachment openings, a slot pierces each of the two handle surfaces. First handle part 1 is pierced by slot 36; second handle part 2 is pierced by slot 37. These slots are parallel to top face 29 and bottom face 33.

First blade supporting surface 16 of central handle part 3 has two raised tracks, top track 38 and bottom track 39. These tracks are parallel to each other as well as the top and bottom of the central handle part 3 and extend inwardly from the front end 20 of central handle part 3. Second supporting surface 17 of central handle part 3 has an identical but mirror image set of tracks, top track 40 and bottom track 41, also extending inwardly from front end 20. These tracks support blade 34 as it moves, bottom track 39 supporting cutting edge 35 of blade 34, and top track 38 supporting the notched edge 42 of blade 34.

Blade holder surface 14 of second handle part 2 is notched to contain a rectangular blade holder depression 43, which is parallel to the top and bottom of handle part 1 and extends inward from front end 18 of first handle part 1. The blade holder depression 43 is large enough to contain blade 34 plus blade holder 46, and the top edge 44 of blade holder depression 43 matches and runs parallel to top track 40 of central handle part 3. The bottom edge 45 of blade holder depression 43 matches and runs parallel to bottom track 41 of central handle part 3. Fitting into blade holder depression 43 of second handle part 2 is blade holder 46.

Figure 7:
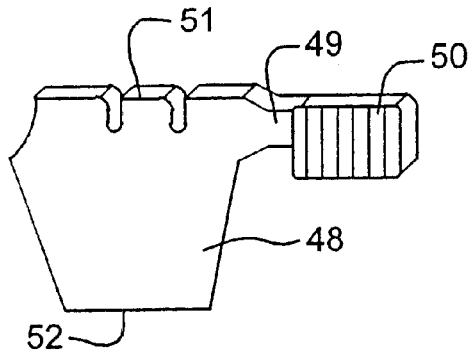
FIG. 7 is a perspective view of the blade holder of the utility knife of the present invention, showing the side of the blade holder, which contacts the blade handle.
Figure 8:
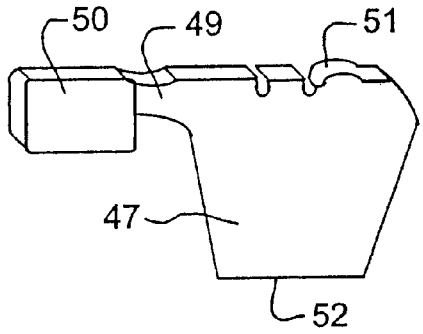
FIG. 8 is a perspective view of the blade holder of the utility knife of the present invention, showing the side of the blade holder, which contacts the blade.
Figure 9:
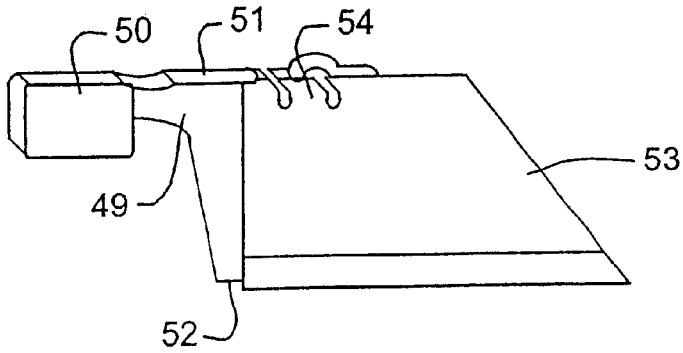
FIG. 9 is a perspective view of the blade holder of the utility knife of the present invention, showing the side of the blade holder, which contacts the blade, containing a blade.

The blade holder 46, pictured separately in FIGS. 7, 8, and 9 has a blade surface 47, illustrated in FIG. 7, a handle surface 48, illustrated in FIG. 8, a tab end 49 and a raised lever 50. Blade surface 47 has a top 51 and a bottom 52. Top 51 of blade surface 47 is bent at a greater than ninety-degree angle to overhang blade 53 and the notched edge 54 of blade 53 is fitted under the overhanging top 51. This works with the tracks of the central handle part to hold the blade in position.

Figure 10:
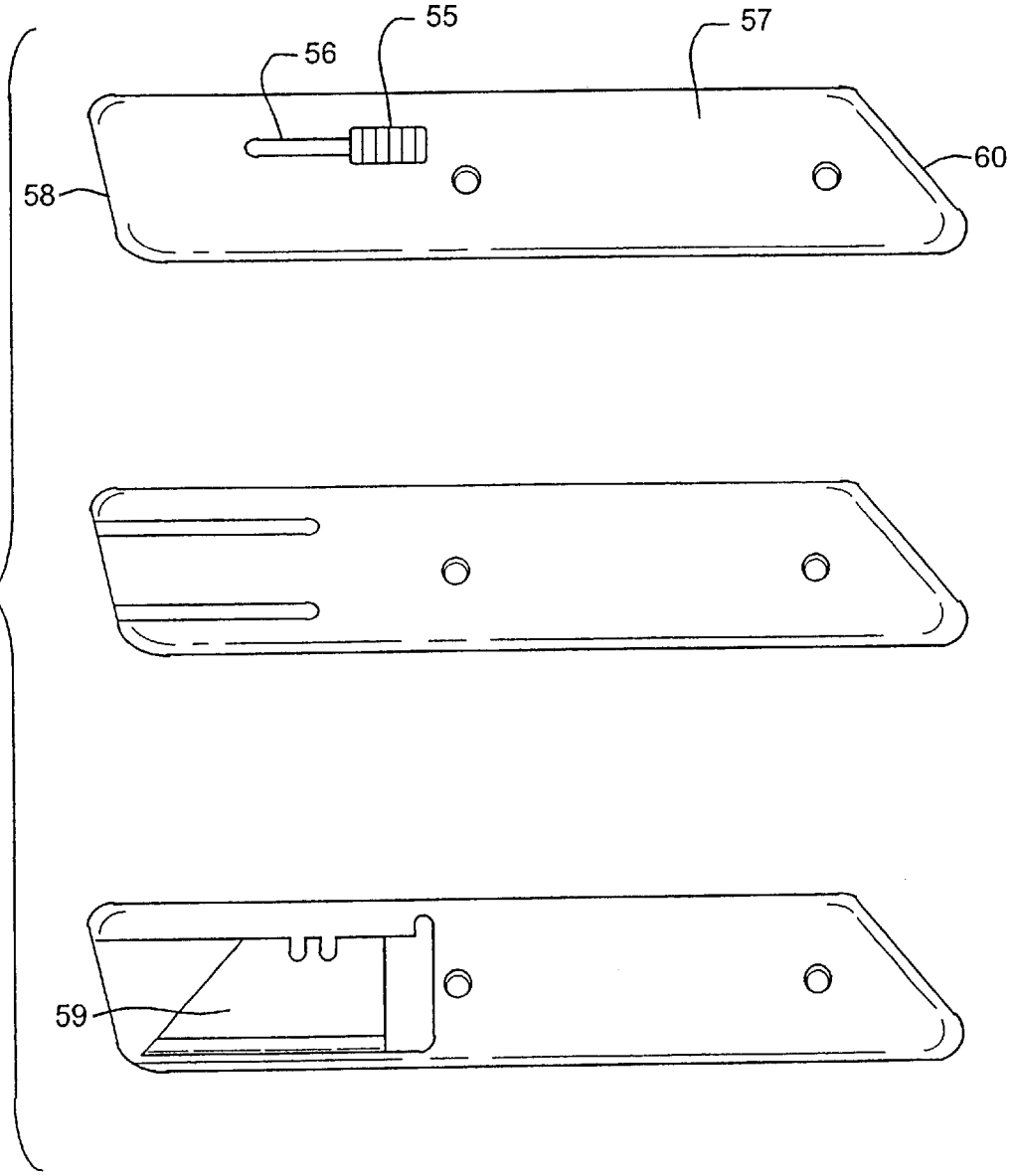
FIG. 10 is a perspective view of the user surface of the utility knife of the present invention, showing the raised lever extending through the slot in the handle part, which allows the user to extend or retract the blade.

The raised lever 55, pictured in FIG. 10 is sized to fit through the slot 56 in first or second handle portion 57 to provide the mechanism which, when moved toward the front face 58 extends the blade 59 and when moved towards the rear face 60 retracts the blade 59.

Figure 11:
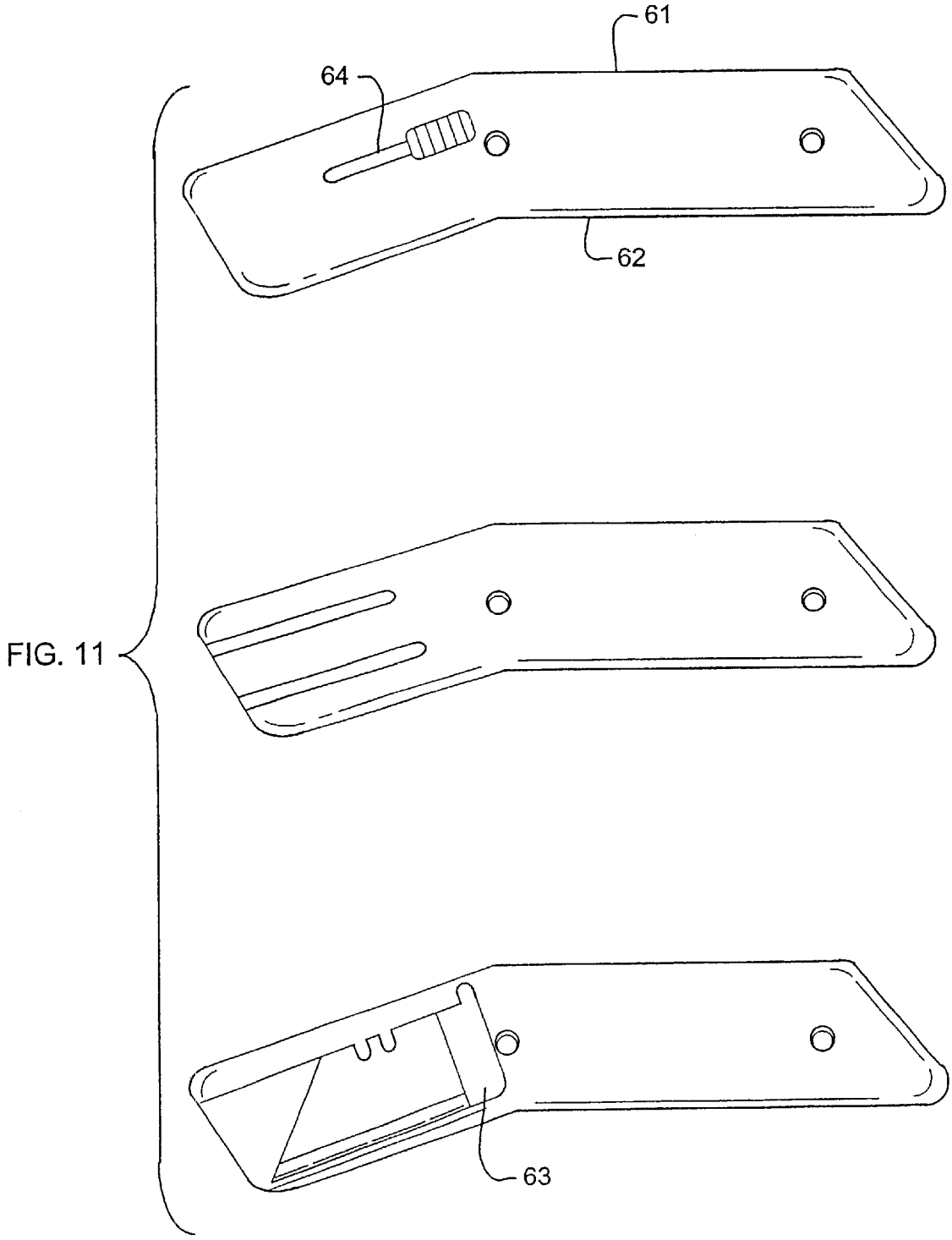
FIG. 11 is a perspective view of alternate configuration of the utility knife of the present invention, wherein the portion of the handle parts and central parts contacting the blade mechanisms are angled.

FIG. 11 depicts another of the preferred embodiments, wherein top face 61 and bottom face 62 are angled. Maintaining the alignment described above results in a utility knife assembly which has a bend in the handle rearward of the blade holder depression 63 and the retraction/extension mechanism 64. This bend greatly enhances the ergonomic ease of use of the utility knife.

Figure 12:
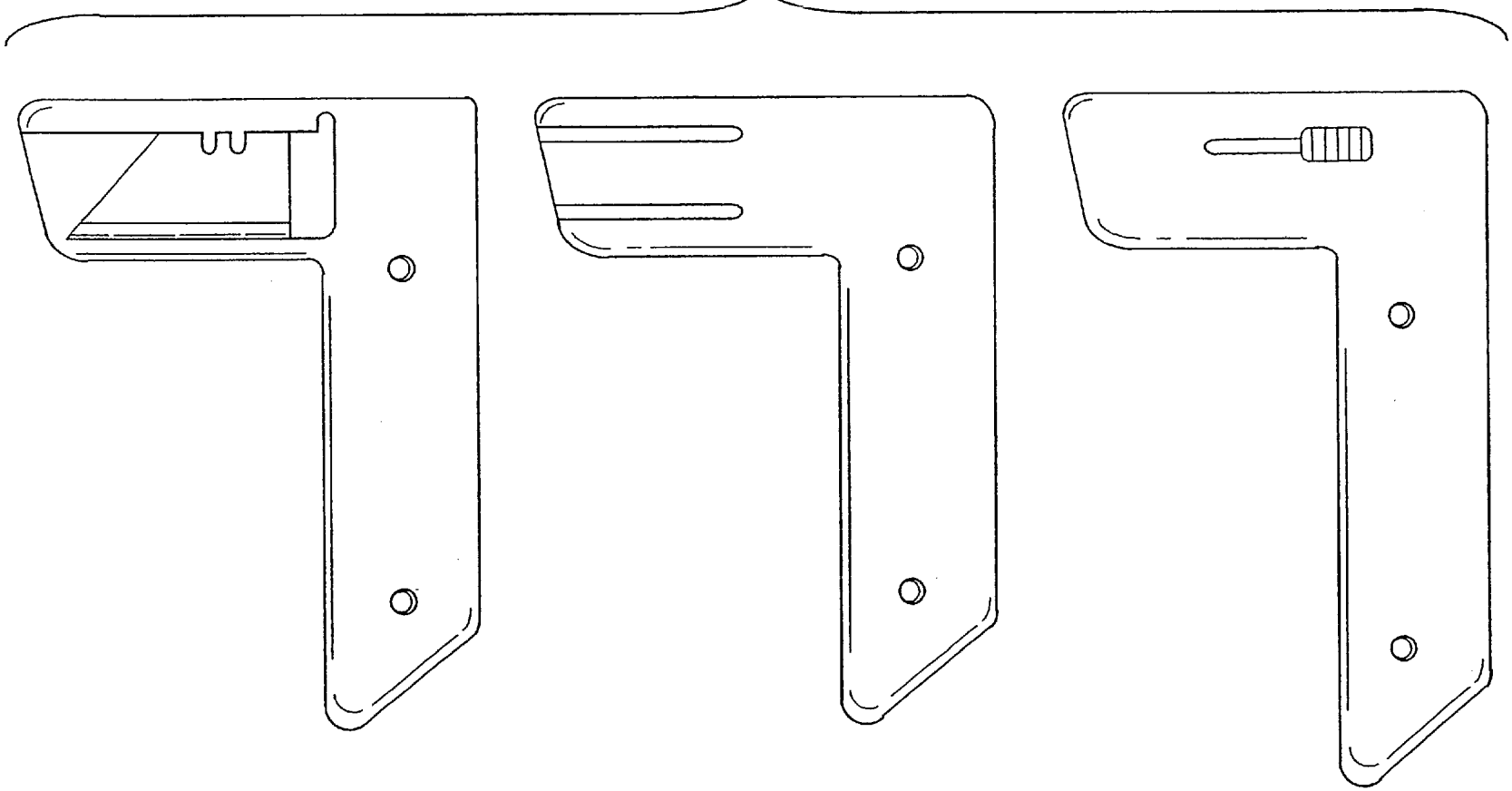
FIG. 12 is a perspective view of alternate configuration of the utility knife of the present invention, wherein the portion of the handle parts and central parts contacting the blade mechanisms are angled at a ninety degree angle.

FIG. 12 depicts another embodiment, wherein the angle of the bend of the handle assembly is ninety (90) degrees.

What is claimed is:

1. A utility knife comprising:

an attachment means:

a first handle part, further comprising:

at least two first attachment openings piercing said first handle part to allow passage of said attachment means through said first handle part;

a first front;

a first rear, opposite said first front;

an angled first top, perpendicular to said first front and said first rear and positioned longitudinally between and having a forward angled part and a rearward angled part;

an angled first bottom, perpendicular to said first front and said first rear and positioned longitudinally between and opposite but parallel to said angled first top and having a forward angled bottom part and a rearward angled bottom part;

a first external user surface, perpendicular to said first front, said first rear, said angled first top, and said angled first bottom and running parallel to said angled first top and said angled first bottom;

first blade holder surface parallel to said external user surface, further comprising:

a first rectangular blade holder depression, indented into said first blade holder surface and parallel to said forward angled part of said angled first top and said forward angled bottom part of said angled first bottom, extending from said first front toward said first rear, said first rectangular blade depression having a first depression top edge and a first depression bottom edge;

a first slot piercing said first handle part, parallel to said forward angled part of said angled first top and said forward angled bottom part of said angled first bottom;

a second handle part parallel to said first handle part and essentially a mirror image of said first handle part, said second handle part further comprising:

at least two second attachment openings piercing said second handle part to allow passage of said attachment means through said second handle part;

a second front;

a second rear, opposite said second front an angled second top, perpendicular to said second front and said second rear and positioned longitudinally between and having a forward angled part and a rearward angled part;

an angled second bottom, perpendicular to said second front and said second rear and positioned between and opposite but parallel to said angled second top and having a forward angled bottom part and a rearward angled bottom part;

a second external user surface, perpendicular to said second front, said second rear, said angled second top, and said angled second bottom and running parallel to said angled second top and said angled second bottom;

a second blade holder surface parallel to said second external user surface, further comprising:

a second rectangular blade holder depression, indented into said second blade holder surface and parallel to said forward angled part of said angled second top and said forward angled bottom part of said angled second bottom, extending from said second front toward said second rear, said second rectangular blade depression having a second depression top edge and a second depression bottom edge;

a second slot piercing said second handle part, parallel to said forward angled part of said angled second top and said forward angled bottom part of said angled second bottom;

a central handle part, positioned between said first handle part and said second handle part and separating said first handle part and said second handle part, said central handle part further comprising:

at least two central attachment openings piercing said central handle part to allow passage of said attachment means through said central handle part;

a central front, aligned with said first and said second fronts to form;

a front knife face, perpendicular to said first and said second handle external user surfaces of said first and said second handle parts;

a central rear, opposite to said central front and aligned with said first and said second rears to form;

a rear knife face; perpendicular to said first and said second handle external user surfaces of said first and said second handle parts and at opposite ends of said first and second handle external user surfaces from said front knife face;

a central top, positioned between said central front and said central rear, perpendicular to said first and said second external user surfaces, said first and said second blade holder surfaces, and aligned with said angled first and said angled second tops to form;

a top knife face, perpendicular to said first and said second handle external user surfaces;

a central bottom, angled to and positioned between said central front and said central rear and opposite and parallel to said central top, and aligned with said first and said second bottoms to form;

a bottom knife face, perpendicular to said first and said second handle external user surfaces;

a first central blade supporting surface in contact with one of either said first handle part or said second handle part, further comprising:

a first top raised track, contacting and parallel to said first depression top edge; and a first bottom raised track, parallel to said top raised track as well as said central top and said central bottom of said central handle part and extending from said central front of said central handle part towards said central rear and in contact with said first depression top edge;

a second central blade supporting surface, parallel and opposite to said first central blade supporting surface, which is a mirror image of said first central blade supporting surface, and is in contact with said first handle part or said second handle part, whichever is not in contact with said first central blade supporting surface, further comprising:

a second top raised track, contacting and parallel to said second depression top edge; and a second bottom raised track, parallel to said top raised track as well as said central top and said central bottom of said central handle part and extending from said central front of said central handle part towards said central rear and in contact with said second depression top edge;

two blade holders, each blade holder further comprising:

a blade surface, having:

a blade surface top on one end, said blade surface top being bent at a greater than ninety degree angle and a blade surface bottom opposite said blade surface top;

a handle surface, parallel to said blade surface;

a tab end at an angle to and separating said blade surface top and said blade surface bottom; and a raised lever, connected to said blade holder by said tab end and positioned to fit through said first slot or said second slot.

2. A utility knife comprising:

an attachment means;

a first handle part further comprising:

at least two first attachment openings piercing said first handle part to allow passage of said attachment means through said first handle part;

a first front;

a first rear, opposite said first front;

a first top, angled to said first front and said first rear and positioned longitudinally between;

a first bottom, angled to said first front and said first rear and positioned longitudinally between and opposite but parallel to said first top;

a first external user surface, perpendicular to said first front, said first rear, said first top, and said first bottom and running longitudinally parallel to said first top and said first bottom;

a first blade holder surface parallel to said external user surface, further comprising:

a first rectangular blade holder depression, indented into said first blade holder surface and parallel to said first top and said first bottom, extending inwardly from said first front toward said first rear, said first rectangular blade depression having a first depression top edge and a first depression bottom edge;

a first slot piercing said first handle part, parallel to said first top and said first bottom;

a second handle part parallel to said first handle part and essentially a mirror image of said first handle part; said second handle part further comprising:

at least two second attachment openings piercing said second handle part to allow passage of said attachment means through said second handle part;

a second front;

a second rear, opposite said second front;

a second top, angled to said second front and said second rear and positioned longitudinally between;

a second bottom, angled to said second front and said second rear and positioned longitudinally between and opposite but parallel to said second top;

a second external user surface, perpendicular to said second front, said second rear, said second top, and said second bottom and running longitudinally parallel to said second top and said second bottom;

a second blade holder surface parallel to said second external user surface, further comprising:

a second rectangular blade holder depression, indented into said second blade holder surface and parallel to said second top and said second bottom, extending inwardly from said second front toward said second rear, said second rectangular blade depression having a second depression top edge and a second depression bottom edge;

a second slat piercing said second handle part, parallel to said second top and said second bottom;

a central handle part, positioned between said first handle part and said second handle part and separating said first handle part and said second handle part, said central handle part further comprising:

at least two central attachment openings piercing said central handle part to allow passage of said attachment means through said central handle part;

a central front, aligned with said first and said second fronts to form;

a front knife face, perpendicular to said first and said second handle external user surfaces of said first and said second handle parts;

a central rear, opposite said central front and aligned with said first and said second rears to form;

a rear knife face, perpendicular to said first and said second handle external user surfaces of said first and said second handle parts and at opposite ends of said first and second handle external user surfaces from said front knife face;

a central top, angled to said central front and said central rear and positioned longitudinally between, perpendicular to said first and said second external user surfaces, said first and said second blade holder surfaces, and aligned with said first and said second tops to form;

a top knife face, perpendicular to said first and said second handle external user surfaces and angled to said front knife face;

a central bottom, angled to and positioned longitudinally between said central front and said central rear and opposite and parallel to said central top, and aligned with said first and said second bottoms to form;

bottom knife face, perpendicular to said first and said second handle external user surfaces and angled to said front knife face;

a first central blade supporting surface in contact with one of either said first handle part or said second handle part, further comprising:

a first top raised track, contacting and parallel to said first depression top edge; and a first bottom raised track, parallel to said top raised track as well as said central top and said central bottom of said central handle part and extending inwardly from said central front of said central handle part towards said central rear and in contact with said first depression top edge;

a second central blade supporting surface, parallel and opposed to said first central blade supporting surface, which is a mirror image of said first central blade supporting surface; and is in contact with said first handle part or said second handle part, whichever is not in contact with said first central blade supporting surface, further comprising:

a second top raised track, contacting and parallel to said second depression top edge; and a second bottom raised track, parallel to said top raised track as well as said central top and said central bottom of said central handle part and extending inwardly from said central front of said central handle part towards said central rear and in contact with said second depression top edge;

two blade holders, each blade holder further comprising:

a blade surface having a blade surface top end, said blade surface top end being bent at a greater than ninety degree angle and, a blade surface bottom opposite said blade surface top end;

a handle surface, parallel and opposite facing to said blade surface;

a tab end at an angle to and separating said blade surface top end and said blade surface bottom; and a raised lever, connected to said blade holder by said tab end and positioned to fit through one of said first slot and said second slot.

3. A utility knife comprising:

a handle including:

a first handle portion having a top side, a bottom side, an external side, a first blade passage at one end, and a first actuator aperture on said external side;

a second handle portion being substantially a mirror image of said first handle portion and having a top side, a bottom side, an external side, a second blade passage at one end, and a second actuator aperture on said external side wherein said first actuator aperture and said second actuator aperture are located on opposite sides of said handle;

a central handle portion disposed between said first and said second handle portions and being substantially flat and having a first and a second upper track and a first and a second lower track disposed in said first handle portion and said second handle portion respectively, said first upper and first lower tracks defining said first blade passage and said second upper and lower tracks defining said second blade passage;

a first blade holder located in said first blade passage for supporting a first blade and a first actuator coupled to said first blade holder and disposed perpendicular to said first blade holder for positioning said first blade holder and said first blade relative to said handle; and a second blade holder located in said second blade passage for supporting a second blade and a second actuator coupled to said second blade holder and disposed perpendicular to said second blade holder for positioning said second blade holder and said second blade relative to said handle.

4. The utility knife as claimed in claim 3 wherein said first and second blade holders are disposed at least five degrees from a main axis of said handle.

* * * * *